US005085353A

United States Patent [19]

Inui et al.

[11] Patent Number: 5,085,353

[45] Date of Patent: Feb. 4, 1992

[54] ACTUATOR FOR LIQUID EJECTION

[75] Inventors: Ryosuke Inui, Yamagata; Susumu Matsubara, Tokyo, both of Japan

[73] Assignees: Takasago Perfumery Co., Ltd., Tokyo; Kabushiki Kaisha Tatsumi Kogyo, Yamagata, both of Japan

[21] Appl. No.: 651,293

[22] Filed: Jan. 11, 1991

[30] Foreign Application Priority Data

Jan. 12, 1990 [JP] Japan ..... 2-2231[U]
Dec. 28, 1990 [JP] Japan ..... 2-415948

[51] Int. Cl.[5] ..... B65D 83/00

[52] U.S. Cl. ..... 222/402.13; 222/402.25; 222/518; 222/501; 239/337; 239/353

[58] Field of Search ..... 222/402.13, 402.25, 222/496, 497, 501, 518; 239/337, 353, 489

[56] References Cited

U.S. PATENT DOCUMENTS 3,568,933 3/1971 Benson ..... 239/337
3,712,517 1/1973 Davenport ..... 222/402.13
3,785,335 1/1974 Wagner ..... 222/402.25
3,889,856 6/1975 Morane ..... 222/402.13
4,860,933 8/1989 Morane et al. ..... 222/518

*Primary Examiner*—H. Grant Skaggs
*Attorney, Agent, or Firm*—Cushman, Darby & Cushman

[57] ABSTRACT

An actuator for liquid ejection which is provided with a plug for closing the ejection spout disposed at the distal portion thereof. This actuator is capable of preventing a residual liquid which is left inside the actuator after an ejection operation from being contacted with an outer atmosphere, thereby preventing the denaturing or degradation of the liquid. Further, it is capable of preventing an ejection spout from being stopped up and of preventing a filmy cover or block to be made. This plug is mounted on an elastic rod-like member disposed in and along the liquid-discharging passage, and is adapted to be moved backward, thus opening the ejection spout as the elastic rod-like member is forced to bend by an actuating rod when the actuator is pushed downward.

8 Claims, 6 Drawing Sheets

ACTUATOR FOR LIQUID EJECTION

BACKGROUND OF THE INVENTION (a) Field of the Invention

This invention relates to an actuator for liquid ejection, which is adapted to be mounted on a container filling therein a pressurized liquid, and in particular to an actuator for liquid ejection which is capable of ejecting a jet flow of a liquid from a ejection spout by pressing the actuator downward, and at the same time capable of preventing any residual liquid left inside the ejection spout from leaking out of the ejection spout by means of a plug.

(b) Description of the Prior Art

An actuator for liquid ejection comprising a liquid introduction tube, which is adapted to be connected to a spout of a container filling therein a pressurized liquid such as cosmetics, and a ejection spout for ejecting a jet flow of the liquid and communicating with the fluid introducing tube through a fluid-discharging passage is conventionally known.

In the case of this conventional actuator, a fine hole is bored through the upper wall portion of the fluid introduction tube, and this fine hole is tightly covered with a ring-like elastic belt made for example of rubber.

When this actuator is operated to eject the liquid, the liquid is first introduced from the container under pressure into the fluid introduction tube, and then the fluid thus introduced therein is ejected out of the fine hole to push and enlarge the ring-like elastic belt, thereby to form a gap between the elastic belt and the outer surface of the fluid introduction tube, and passes through the gap to the ejection spout to be ejected out.

After the fluid ejection operation of the actuator, the fine hole is tightly covered again by the ring-like elastic belt. However, since the ejection spout is left uncovered, any fluid which is ejected from the fine hole, but remains inside the fluid-discharge passage is naturally exposed to air entering from the ejection spout.

When the liquid to be ejected is of post-foamable nature, it is hardly avoidable to cause the liquid to foam inside the ejection spout. It is also probable that the liquid remained inside the fluid-discharge passage is oxidized thereby degrading the quality of the liquid.

Further, the liquid ejected from the fine hole may be leaked out of the container through a gap formed at the connecting portion between the spout of the container and the actuator.

Since the ejection spout is open at any time, it is hardly avoidable to cause membranous cover to be made thereat and to stop up the spout.

SUMMARY OF THE INVENTION

The present invention has been made in view of the circumstances as mentioned above, and has its main object to provide an actuator for liquid ejection, which is capable of preventing a residual liquid which is left inside the actuator after an ejection operation from being contacted with an outer atmosphere, thereby preventing the denaturing or degradation of the liquid, and which is capable of preventing any leakage of the liquid from the ejection spout.

Further, it is capable of preventing a ejection spout from being stopped up and of preventing a membranous cover to be made.

In order to achieve above objects, the present invention provides an actuator for liquid ejection, which is adapted to be mounted on a container filling therein a pressurized liquid, and comprises:

(a) a fluid-introduction passage, which is adapted to be communicated with a spout of the container;

(b) a fluid-discharging passage intersecting with a distal end of said fluid-introduction passage, and forming a ejection spout at a tip portion thereof;

(c) an actuating rod coaxially disposed in said fluid-introduction passage, a proximal end thereof being adapted to press the spout portion of the container, and a distal end portion thereof being projected into said fluid-discharging passage;

(d) an elastic rod-like member disposed in and along said fluid-discharging passage, a proximal end portion thereof being secured to the proximal end portion of said fluid-discharging passage, and a middle portion thereof crossing over the distal end portion of said actuating rod;

(e) a plug attached to the distal end portion of said actuating rod, and adapted to close said ejection spout formed at the tip portion of said fluid-discharging passage, said plug being forced to move backward to open the ejection spout, as said elastic rod-like member is forced to be arched by a pushing movement of said actuating rod against the middle portion of said elastic rod-like member, thereby communicating said ejection spout with said fluid-discharging passage.

This actuator can be operated as follows. When the actuator is pushed downward, the elastic rod-like member pushes the actuating rod downward while being arched due to its elasticity.

The actuating rod pushes the spout portion of the container and causes pressurized fluid to enter into the fluid-introduction passage.

At the same time, due to the bending of the elastic rod-like member, the plug which is fixed to the tip portion of the elastic rod-like member is retreated from sealing position thereof at the ejection spout to communicate with the fluid-discharge passage.

Accordingly, the liquid contained in the container can be first discharged into the fluid-introduction passage, and then into the fluid-discharging passage, and finally ejected from the ejection spout.

When the actuator is released from pushing force, the elastic rod-like member is restored to the original state, thereby causing the plug to seal the ejection spout.

As a result, the liquid discharged from the spout of the container is confined within the fluid-introduction passage or the fluid-discharging passage by the sealing of the plug, thereby preventing the denature and degradation of the liquid as well as the leakage of the liquid from the container.

DESCRIPTION OF THE PREFERRED EMBODIMENTS

The invention will now be described in conjunction with the preferred embodiments thereof with reference to the drawings.

Figure 1:
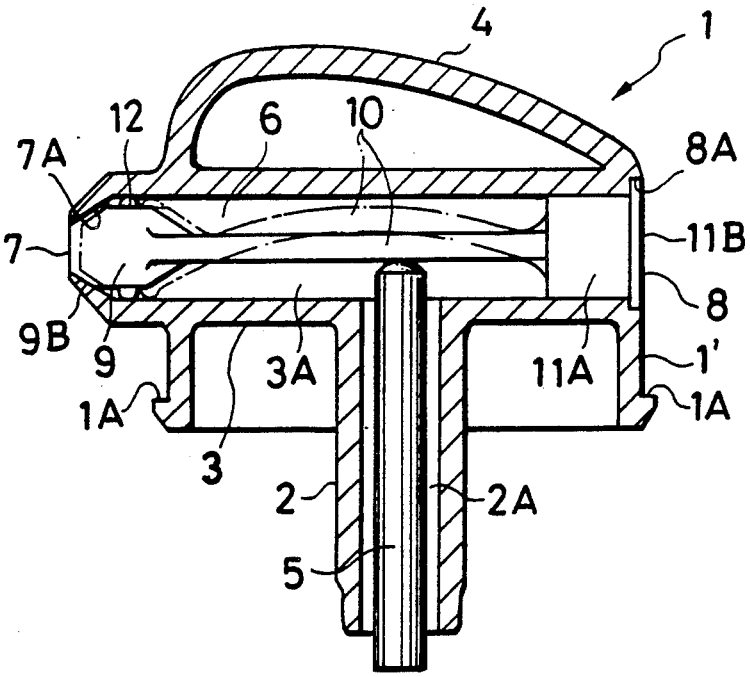
FIG. 1 is a sectional view of an actuator for liquid ejection according to one embodiment of the present invention.
Figure 2:
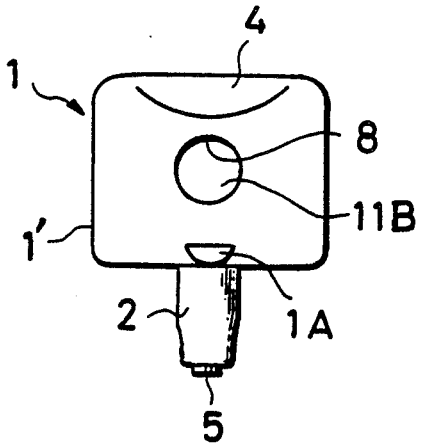
FIG. 2 is a rear side view of the actuator shown in FIG. 1.
Figure 4:
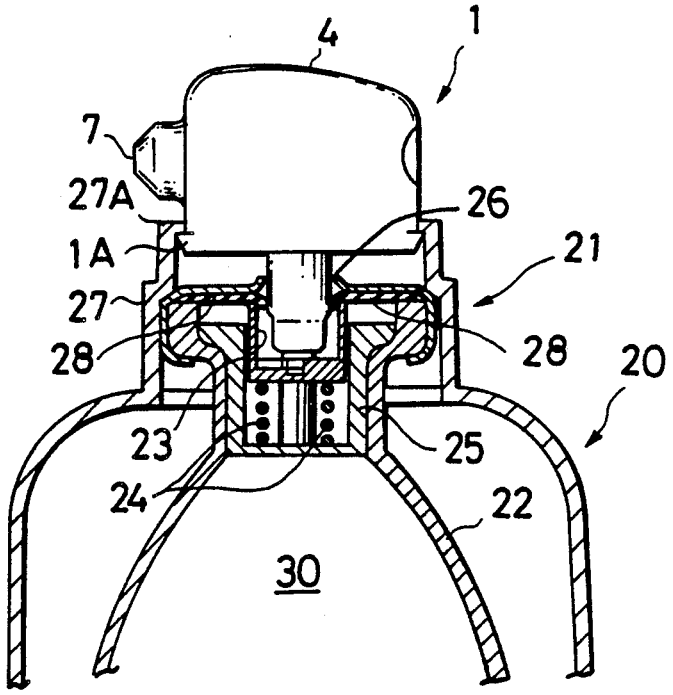
FIG. 4 is a sectional view showing a main portion of a container mounting thereon an actuator.

As shown in FIGS. 1 and 2, an actuator for liquid ejection 1 according to a first embodiment is generally formed of a plastic nozzle body, which is adapted to eject a post-foamable liquid, and is adapted to be detachably mounted to a spout 21 of a container 20 shown in FIG. 4.

Figure 5:
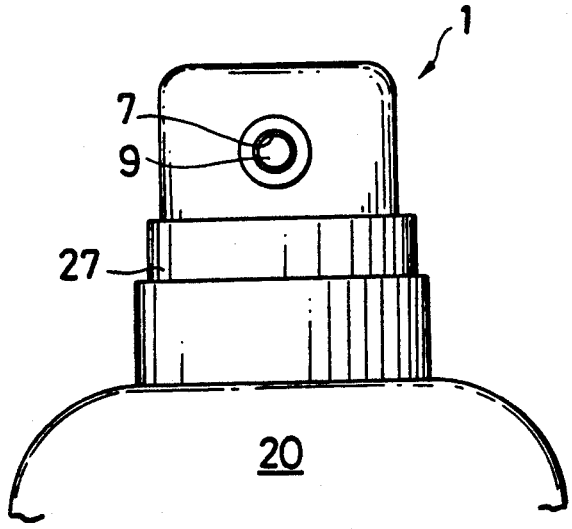
FIG. 5 is a front view of the container shown in FIG. 4.

This container 20, as shown in FIGS. 4 and 5, houses therein an inner vessel 22 filling therein a liquid 30 (a post-foamable liquid) under a prescribed pressure, and a valved spout 21 mounted on the upper portion of the inner vessel 22.

This spout 21 comprises an inner opening 26 communicating with the inner vessel 22, a mounting portion 27 surrounding the inner opening 26, an inner cap 23 which is adapted to open or close the inner opening 26 from inside, a coil spring 24 energizing the inner cap 23 to keep its closed state, and a holder 25 housing the inner cap 23 and the spring 24, having a side hole or holes for introducing the liquid 30, and engaging with the opening of the inner vessel 22.

The numeral 28 depicts a gasket made of rubber.

The actuator 1 is integrally molded with polypropylene or polyethylene, and having a cylindrical body 1 as shown in FIG. 1.

This cylindrical body 1 is provided on its lower circumference with a step portion 1A which is adapted to be engaged with the upper step portion 27A of the mounting portion 27, and also with pushing surface 4 on its top surface.

A fluid-discharging passage 3 forming a ejection spout 7 at the tip portion thereof is diametrically extended at the middle portion of the cylindrical body 1 as shown in FIG. 1. This fluid-discharging tube 3 is connected at an intermediate portion thereof with a fluid-introduction tube 2, which is perpendicularly extending therefrom. Therefore, a fluid-introduction passage 2A of the fluid-introduction tube 2 is communicated with a fluid-discharging passage 3A of the fluid-discharging tube 3.

In the fluid-introduction passage 2A is coaxially disposed an actuating rod 5 having a smaller diameter than the inner diameter of the fluid-introduction passage 2A.

This actuating rod 5 is preferably made of a material which is free from quality degradation due to the liquid 30, and has a sufficient strength to withstand a repeated pressing operation without being deformed. For example, a rigid acetal plastic material (Juracon, a trade mark) may be employed.

Both ends of the actuating rod 5 are protruded out of the fluid-introduction passage 2A. Thus, the lower end of the actuating rod 5 is adapted to be contacted with the inner cap 23 as the actuator 1 is mounted to the container 20. Therefore, when the actuating rod 5 is moved downward, the inner cap 23 is caused to descend thereby opening the inner opening 26.

Meanwhile, the ejection spout 7 has a tapering surface 7A so that width of the ejection spout 7 is gradually narrowed toward the forward center.

The proximal end of the fluid-discharging tube 3 which is in opposite to the ejection spout 7 is opened to form an opening 8 for attaching the elastic rod-like member. On this opening 8 is formed an engaging step portion 8A having a diameter larger than the inner diameter of the fluid-discharging passage 3A.

Inside the fluid-discharging passage 3A is disposed an elastic rod-like member 6 along the length thereof.

Figure 3:
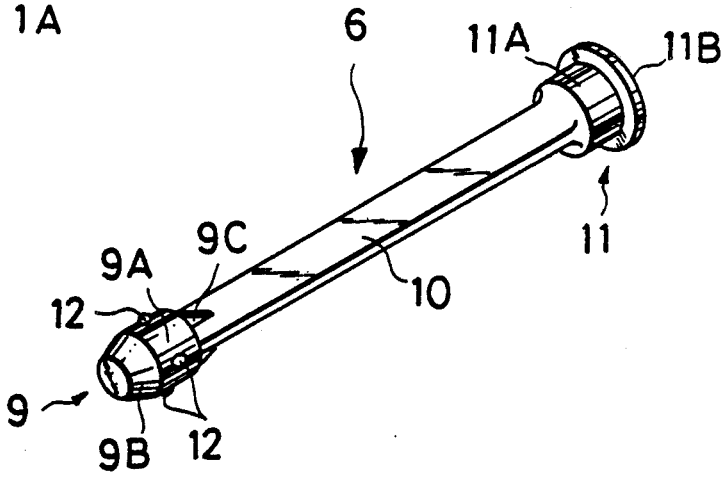
FIG. 3 is a perspective view of an elastic rod-like member.

This elastic rod-like member 6, which may be made of nylon or acetal resin, comprises as clearly shown in FIG. 3 a plate-like elastic portion 10 having a tip portion attached with a plug 9, and a proximal end portion attached with a mounting disc 11.

This plug 9 comprises a proximal end portion 9A formed into a disc-like shape having a diameter smaller than the inner diameter of the fluid-discharging passage 3A, and a distal end portion formed into a frustum-conical shape having a tapering surface 9B having substantially the same inclination angle as that of the tapering surface 7A of the ejection spout 7, thereby making it possible to close the ejection spout 7.

In the above embodiment, the sealing of the ejection spout 7 is effected through the contact between the tapering surface 7A and the tapering surface 9B. However, it is also possible to effect the sealing of the ejection spout 7 by providing other sealing means, for example by mounting an O-ring on the tapering surface.

The reference numeral 9C indicates a reinforcing rib connected to the proximal end portion 9A.

On the outer circumferential surface of the proximal end portion 9A of the plug 9 are projected a plurality of semi-circular guide members 12 (four in number, and set apart from each other at an equal interval) so as to contact with the inner wall of the fluid-discharging passage 3A, and to allow the plug 9 to reciprocally move along the axis of the fluid-discharging passage 3A.

The mounting disc 11 comprises a fitting disc portion 11A having a diameter which is equal to the inner diameter of the fluid-discharging passage 3A, and a flange portion 11B which is radially protruded from the fitting disc portion 11A and is adapted to engage with the stepped portion 8A of the mounting opening 8.

The fitting disc portion 11A is snugly fitted in the mounting opening 8 provided at the proximal end portion of the fluid-discharging passage 3A, and at the same time the flange portion 11B is engaged with the stepped portion 8A, thereby mounting the elastic rod-like member 6 within the fluid-discharging passage 3A.

In this manner, the elastic rod-like member 6 is coaxially set within the fluid-discharging passage 3A, and the plug 9 is set to close the ejection spout 7 (FIGS. 1 and 3).

The actuating rod 5 is arranged in such a manner that the top end portion thereof is adapted to push an intermediate portion of the plate-like member 10 of the elastic rod-like member 6.

Next, the operation of the actuator for liquid ejection constructed as explained above will be illustrated with reference to FIGS. 1 and 4.

When the pushing surface 4 is pushed downward, the elastic rod-like member 6 is forced to move downward, thereby pushing the actuating rod 5 downward via the plate-like member 10 of the elastic rod-like member 6. At this moment, the plate-like member 10 is forced to bend due to the pressure contact thereof with the actuating rod 5 (see the phantom line shown in FIG. 1).

Then, the actuating rod 5 pushes the inner cap 23 of the inner container 20 to move it downward, thereby forming a space between the top portion of the inner cap 23 and the gasket 28. Accordingly, the liquid 30 in a pressurized state can be discharged into the fluid-introduction passage 2A via the inner opening 26.

Meanwhile, due to the bending of the plate-like member 10 of the elastic rod-like member 6, the distal end portion of the plate-like member 10 mounting thereon the plug 9 is forced to retreat backward. To be more specific, the plug 9 moves along the axis of the fluid-discharging passage 3A, from the spout-closing position as indicated in a solid line in FIG. 1 to the spout-opening position as indicated in a phantom line in FIG. 1 while being guided by the semi-circular guides 12 and keeping a space between the outer surface thereof and the inner wall of the fluid-discharging tube 3.

At this moment, the liquid 30 thus introduced under pressure into the fluid-introduction passage 2A is ejected via the fluid-discharging passage 3A from the ejection spout 7.

When liquid ejection operation is finished by releasing the pressing of the pushing surface 4, the inner cap 23 automatically moves upward to the original closing position to finally close the inner opening 26 due to the restoring force of the spring 24, and at the same time the actuator 1 moves upward.

Moreover, since the elastic rod-like member 6 is also released of the external force, the elastic rod-like member 6 is restored to its original position as indicated by a solid line due to the elastic restoring force of the plate-like elastic member 10, thereby causing the plug 9 to close the ejection spout 7.

In this case, the liquid which is discharged from the inner vessel 20 and remains within the fluid-discharging passage 3A or the fluid-introduction passage 2A is prevented from being exposed to outer atmosphere due to the closing action of the plug 9.

Figure 6:
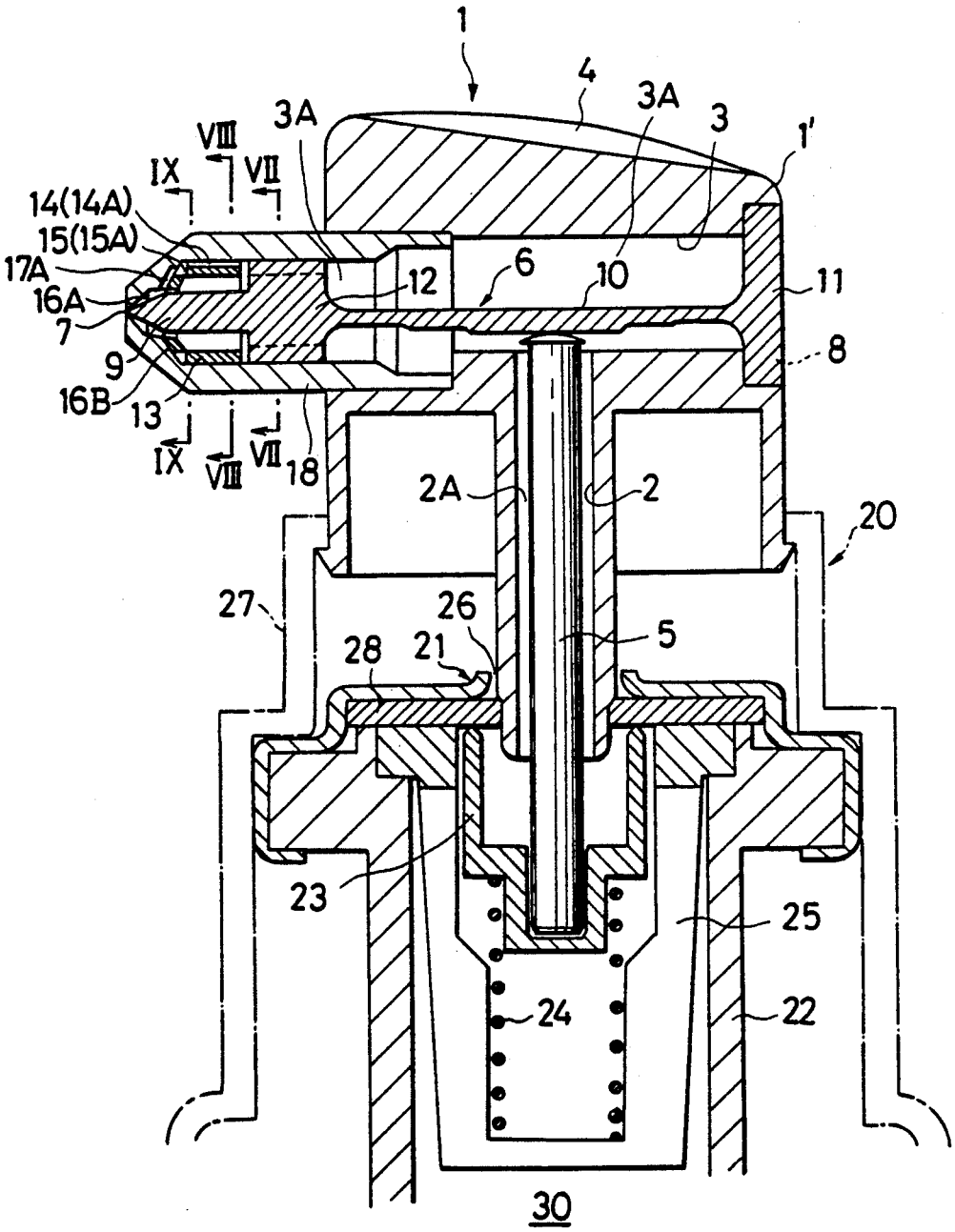
FIG. 6 is a sectional view showing another embodiment of an actuator according to the present invention.

FIG. 6 shows another embodiment of an actuator 1 according to the present invention, which is adapted to eject a vaporized liquid. In this embodiment, a fluid-discharging tube 3 having the ejection spout 7 for spray on its distal end is integrally formed at the middle portion of the body 1, and the fluid-introduction tube 2 is perpendicularly connected to an intermediate portion of the fluid-discharging tube 3 to communicate with the fluid-discharging tube 3 in the same manner as in the first embodiment mentioned above.

In the liquid-introduction passage 2A is disposed the actuating rod 5 in such a manner that both ends thereof are protruded from the fluid-discharging passage 3, and the elastic rod-like member 6 is disposed in the fluid-discharging passage 3A.

The forward half portion of the liquid-introduction passage 2A is constituted by the inner wall of the cylindrical nozzle 18 fitted in the distal end portion of the body 1.

Figure 10:
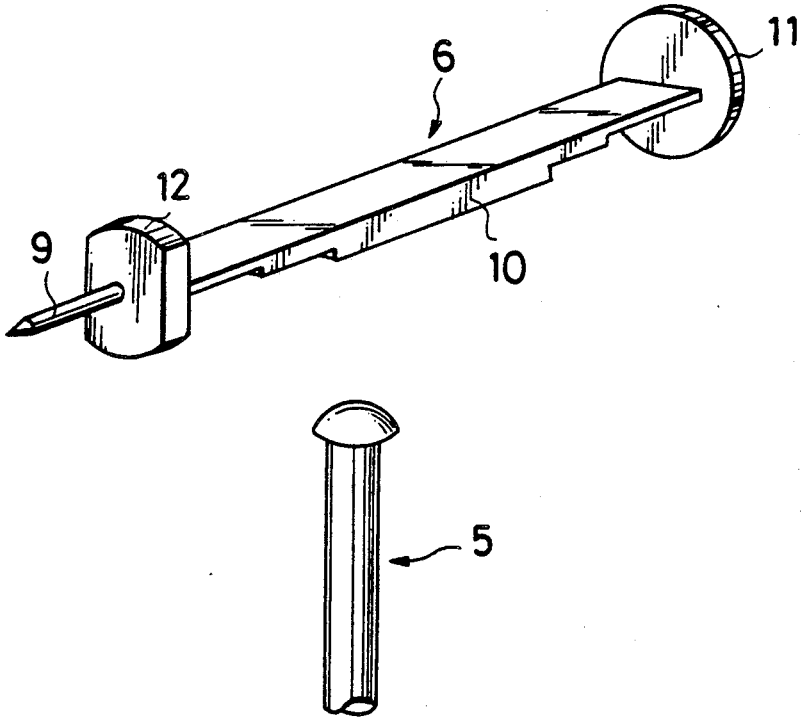
FIG. 10 a sectional view showing an elastic rod-like member and an actuating rod.

The elastic rod-like member 6 comprises, as shown in FIGS. 6 and 10, the plug 9 mounted at the distal end thereof and adapted to close the ejection spout 7 for spray, and the guide portion 9A having an oval cross-section.

Figure 7:
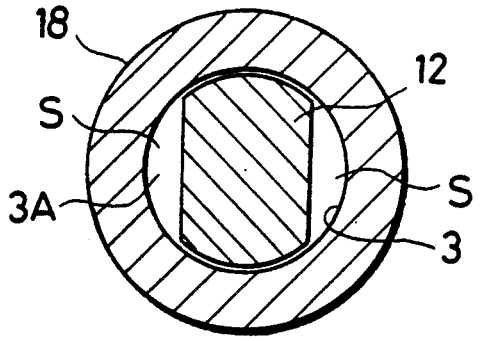
FIG. 7 is a sectional view taken along a line VII—VII of FIG. 6.
Figure 8:
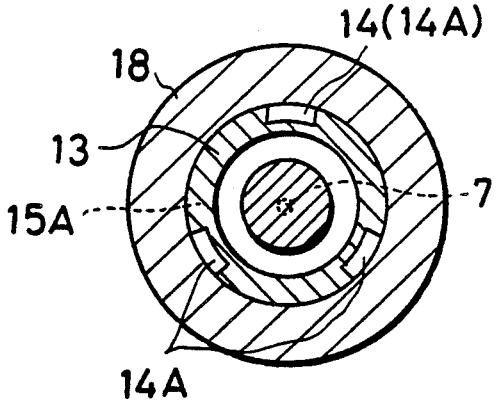
FIG. 8 is a sectional view taken along a line VIII—VIII of FIG. 6.

The wall portions, having a longer diameter, of guide portion 9A are slidably contacted with the inner wall of the fluid-discharging tube 3, and the other wall portions, having a shorter diameter and a flat surface, of guide portion 9A form a pair of equal spaces S between the flat surfaces and the inner wall of the fluid-discharging tube 3 (FIG. 7).

The rear side of the guide portion 9A is connected to the distal end of the plate-like elastic member 10, and a mounting disc 11 is fixed at the proximal end of the plate-like elastic member 10.

The plate-like elastic member 10 is constructed in such a manner that the thickness thereof is varied in three steps with the central portion thereof being made thicker than neighboring side portion thereof, thereby enhancing the strength and elasticity thereof.

The mounting disc 11 is snugly fitted in the opening 8 formed at the rear end of the fluid-discharging passage 3A of the body 1, thereby suitably mounting the elastic rod-like member 6 inside the fluid-discharging passage 3A, in such a manner that the elastic rod-like member 6 is coaxially extended and the plug 9 is set at the spout-closing position.

On a distal end portion of the elastic rod-like member 6 which is located behind the plug 9 is inserted thereover with a guiding attachment 13. This guiding attachment 13 comprises a cylindrical member having an axial bore for allowing the passage of the plug 9, wall portions closely contacting with the inner wall surface of the fluid-discharging tube 2, a plurality (three in this embodiment) of guiding grooves 14 formed on the circumferential surface thereof and extending toward the ejection spout 7 for spray, and a stepped portion 15 formed at the distal end portion thereof.

These guiding grooves 14 are spaced from each other at an equal interval, and communicated with the stepped portion 15, thereby forming fluid-introduction passages 14A between the grooves 14 and the inner surface of the fluid-discharging tub 2, and a ring-like fluid passage 15A at the distal end portion thereof.

Meanwhile, the inner wall of the nozzle 18 forming the ejection spout 7 for spray comprises a first tapering surface 16A forming a steep inclination and communicating with the ejection spout 7 for spray, and a second tapering surface 16B forming a rather mild inclination and connected to the first tapering surface 16A.

Figure 9:
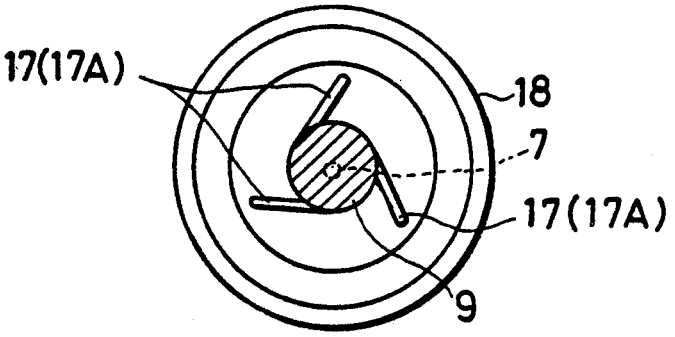
FIG. 9 is a sectional view taken along a line IX—IX of FIG. 6.

On this second tapering surface 16B is formed three spiral guiding grooves 17 disposed at an equal interval, each extending toward the tangent of disc formed behind the first tapering surface 16A as shown in FIG. 9, thereby forming spiral fluid passages 17A between the grooves 17 and the outer circumferential surface of the guiding attachment 13.

The first tapering surface 16A comprises a flatly extending portion which is connected to the distal end portion of the second tapering surface 16B, and a guiding surface extending from the flatly extending portion and inclining at a prescribed ejection angle in the direction of the ejection spout 7 for spray.

Accordingly, a ring-like space communicating with the ring-like fluid passage 15A is formed between the first tapering surface 16A and the plug 9.

Next, the operation of the actuator for liquid ejection constructed as explained above will be illustrated.

Figure 11:
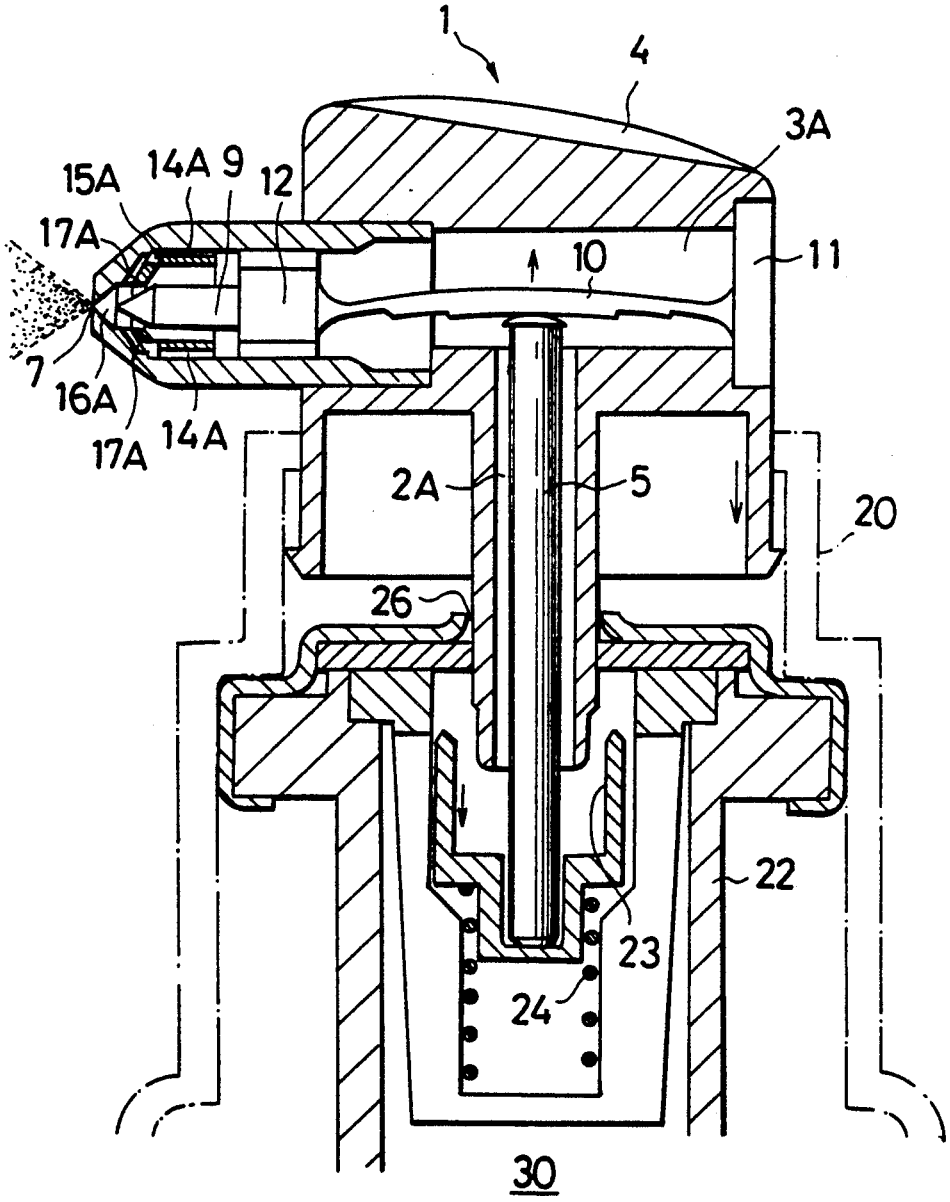
FIG. 11 is a sectional view of an actuator illustrating a state of liquid ejection.

When the pushing surface 4 is pushed downward, the elastic rod-like member 6 is forced to move downward, thereby pushing the actuating rod 5 downward via the plate-like member 10 of the elastic rod-like member 6. At this moment, the plate-like member 10 is forced to bend due to the pressure contact thereof with the (FIG. 11).

This downward movement of the elastic rod-like member 6 causes the liquid 30 contained in the inner vessel 20 to enter into the liquid-introduction passage 2A in the same manner as explained in the previous example.

Meanwhile, due to the bending of the plate-like member 10 of the elastic rod-like member 6, the plug 9 is forced to retreat backward along the axis of the fluid-discharging passage 3A, as guided by the guiding member 9A, thereby opening the ejection spout 7 for spray.

The liquid 30 discharged from the inner vessel passes from the fluid-introduction passage 2A to the fluid-discharging passage 3A, is separated into two streams at the spaces S of the guiding member 9A, and then into three streams at the fluid-introduction passage 14A formed by the guiding attachment 13. These three streams are mixed together at the ring-like passage 15A, and adjusted into a uniform pressure.

This mixed stream is again separated into three streams at the spiral fluid passages 17A as the mixed stream is discharged from the ring-like passage 15A. These streams from the spiral fluid passages 17A are again mixed together at the first tapering surface 16A, thereby forming a spiral flow, which is then ejected from the ejection spout 7 for spray in the form of a vapor jet at a prescribed angle.

When liquid ejection operation is finished by releasing the pressing of the pushing surface 4, the actuator 1 moves upward due to the restoring force of the spring 24.

Moreover, since the elastic rod-like member 6 is also released from external force, a space is formed between the elastic rod-like member 6 and the actuating rod 5, thereby allowing the elastic rod-like member 6 to restore to its original position due to the elastic restoring force of the plate-like elastic member 10, and thereby causing the plug 9 to close the ejection spout 7 for spray (FIG. 6).

In this case, the liquid which is discharged from the inner vessel 20 and remains within the fluid-discharging passage 3A or the fluid-introduction passage 2A is prevented from being exposed to outer atmosphere due to the closing action of the plug 9.

According to the present invention, there is no limitation with respect to the material to be filled in the container, so that liquid or any other fluids can be applicable.

There is also no restriction with respect to the construction for ejecting a fluid filled in a container by utilizing a pressure.

Materials forming each component of the actuator may be made of plastic material as in the above embodiments, but may be formed of any other materials as long as they are not degraded by the fluid to be ejected, and they have a sufficient strength to withstand the operation conditions. It is also possible to employ a coil spring in place of the plate-like elastic member.

As explained above, the actuator according to the present invention is provided with a plug for closing the ejection spout, and an elastic member of simple structure, so that a liquid can be effectively confined in the actuator after an ejection operation and also prevented from being exposed to the outer atmosphere.

Therefore, the denature as well as degradation of the liquid can be effectively prevented, and at the same time, the leadage of the liquid from the container can be effectively prevented.

We claim:

1. An actuator for liquid ejection, which is adapted to be mounted on a container filling therein a pressurized fluid, and comprises:

a fluid-introduction passage, which is adapted to be communicated with a valved spout of the container;

a fluid-discharging passage intersecting with a distal end of said fluid-introduction passage, and forming a ejection spout at a tip portion thereof;

an actuating rod coaxially disposed in said fluid-introduction passage, a proximal end thereof being adapted to press open the valved spout of the container, and a distal end portion thereof being projected into said fluid-discharging passage;

an elastic rod-like member disposed in and along said fluid-discharging passage, a proximal end portion thereof being secured to the proximal end portion of said fluid-discharging passage, and a middle portion thereof crossing over the distal end portion of said actuating rod;

a plug attached to the distal end portion of said actuating rod, and adapted to close said ejection spout formed at the tip portion of said fluid-discharging passage, said plug being forced to move backward to open the ejection spout as said elastic rod-like member is forced to be arched by a pushing movement of said actuating rod against the middle portion of said elastic rod-like member, thereby communicating said ejection spout with said fluid-discharging passage.

2. An actuator for liquid ejection according to claim 1, which further comprises a guide member mounted at the tip portion of said elastic rod-like member, and having projected portions allowing fluid flow therebetween, said projected portions being slidably contacted with the inner wall surface of said fluid-discharging passage.

3. An actuator for liquid ejection according to claim 2, wherein said guide member comprises semi-circular projections spaced apart at a uniform interval and projected from the outer circumferential surface of said plug, tip portions of said semi-circular projections being slidably in contact with the inner wall surface of said fluid-discharging passage.

4. An actuator for liquid ejection according to claim 2, wherein said guide member is oval-shaped in cross-section, and outer wall surfaces of the longer diametrical portion thereof being in contact with the inner wall surface of said fluid-discharging passage, and a space being formed between outer wall surfaces of the shorter diametrical portion thereof and the inner wall surface of said fluid-discharging passage, thereby allowing passage of fluid flow.

5. An actuator for liquid ejection according to claim 1, wherein said fluid-introduction passage is perpendicularly extended from a middle portion of said fluid-discharging passage.

6. An actuator for liquid ejection according to claim 1, wherein said elastic member has a middle portion consisting of a plate-like elastic material.

7. An actuator for liquid ejection according to claim 1, wherein said elastic member is provided at the proximal end thereof with a mounting disc which is adapted to encap an opening formed at the proximal end of said fluid-discharging passage, thereby allowing said elastic member to be secured to said fluid-discharging passage.

8. An actuator for liquid ejection according to claim 1, wherein said ejection spout has an inner wall surface formed thereon with grooves for causing a spiral fluid flow, and an attachment is mounted on the tip portion of said elastic member, said attachment is provided on an outer surface thereof with guiding grooves extending toward said ejection spout.

* * * * *